United States Patent [19]

Kaneko et al.

[11] 4,185,181

[45] Jan. 22, 1980

[54] MICROWAVE OVEN

[75] Inventors: Yoichi Kaneko, Tokorozawa; Katsuhiro Kimura, Tokyo; Mitsuru Watanabe, Yokohama; Tadashi Funamizu, Matsudo; Itsuo Kikuchi, Ibaragi, all of Japan

[73] Assignee: Hitachi Heating Appliances Co., Ltd., Japan

[21] Appl. No.: 843,035

[22] Filed: Oct. 17, 1977

[30] Foreign Application Priority Data

Oct. 18, 1976 [JP] Japan ..... 51-123825

[51] Int. Cl.[2] ..... H05B 9/06

[52] U.S. Cl. ..... 219/10.55 F

[58] Field of Search ..... 219/10.55 F, 10.55 R, 219/10.55 B, 10.55 D, 10.55 M

[56] References Cited

U.S. PATENT DOCUMENTS

| | | | |
|---|---|---|---|
| 2,961,520 | 11/1960 | Long | 219/10.55 F |
| 3,235,701 | 2/1966 | Duras et al. | 219/10.55 F |
| 3,493,709 | 2/1970 | Lavoo et al. | 219/10.55 F |
| 3,526,737 | 9/1970 | Black | 219/10.55 F |
| 3,643,055 | 2/1972 | Suzuki | 219/10.55 F |
| 3,746,823 | 7/1973 | Whiteley | 219/10.55 F |
| 3,936,627 | 2/1976 | Fitzmayer | 219/10.55 F |
| 4,019,010 | 4/1977 | Tanaka et al. | 219/10.55 F |
| 4,028,521 | 6/1977 | Uyeda et al. | 219/10.55 F |
| 4,037,071 | 7/1977 | Kaufman, Jr. | 219/10.55 F |

*Primary Examiner*—Arthur T. Grimley

*Attorney, Agent, or Firm*—Craig and Antonelli

[57] ABSTRACT

A microwave oven having special form of a microwave energy radiation arrangement.

In order to heat uniformly materials to be cooked, the microwave energy radiation arrangement includes a rotatable conductive rod extending into an oven chamber through a hole located substantially in the center of one oven chamber wall, a rotating conductive arm having one end fixed on the rod so as to extend transversely thereto, and a conductive plate having the center thereof coincident with the axis of the rod and arrayed such that the rotating arm is interposed between the one wall and the conductive plate. Openings for radiating microwave energy into the oven chamber are formed at the periphery of the conductive plate.

9 Claims, 4 Drawing Figures

MICROWAVE OVEN

LIST OF PRIOR ART (37 CFR 1.56 (a))

The following references are cited to show the state of art:

U.S. Pat. No. 2,961,520 George B. Long, Nov. 22, 1960, 219-10.55;

U.S. Pat. No. 3,851,133 Hans G. E. Dygve et al., Nov. 26, 1974, 219-10.55.

BACKGROUND OF THE INVENTION (1) Field of the Invention

This invention relates to a heating device, namely, a microwave oven for cooking foods or the like, in which electro-magnetic high frequency waves are used to rapidly cook foods.

(2) Description of the Prior Art

Many types of microwave ovens have been know as a domestic electric oven. But they have still a number of problems to be overcome. One of the problems is that parts of material to be heated are well-heated or overheated, while other parts are not well-heated due to the microenergy distribution in a oven chamber.

Attempts have been made to reduce this problem with sitrrers, rotating antennas and other means. For example, in U.S. Pat. No. 3,851,133, there has been disclosed an antenna chamber which is disposed adjacent to the oven chamber and microwave energy is transferred thereto through radiation slots disposed in that side of the oven chamber adjacent the antenna chamber. In the antenna chamber, four arms of rotating antennas are provided.

However, as microwave radiation from the antenna chamber into the oven chamber is carried through a plurality of small slots, there result standing wave components since many slots form a type of a fixed arrayed antenna, and some part of microwave energy is lost in the antenna chamber.

SUMMARY OF THE INVENTION

An object of this invention is to improve a conventional microwave oven and to provide a microwave oven heating a material or food to be cooked more uniformly.

Another object of this invention is to provide a microwave oven having a microwave energy radiating arrangement which effectively converts a microwave energy from a high frequency source into a heating microwave energy in an oven chamber.

To attain the above objects, a microwave oven in accordance with this invention is constructed as follow.

In microwave oven having an oven chamber within which materials to be cooked are disposed and a microwave energy radiating arrangement which transfers a microwave energy fed from a microwave oscillating source into the oven chamber, the microwave energy radiating arrangement includes a coaxial central conductor or central rod which passes through a hole located substantially in the center of one of the walls enclosing an oven chamber, at least one rotating conductive arm having one end fixed on the central rod and extending transversly thereto, a circular or a regular polygon conductive plate, namely, a shielding plate of which the center is coincident with the axis of the central rod, and supporting means supporting the conductive plate in the vicinity of the wall and in parallel thereto, in such manner that the rotating arm is interposed therebetween with at least one opening for radiating microwave energy into the oven chamber being provided between the wall having the hole and the conductive plate.

In other words, the wall, the arm and the conductive plate forms a rotating tri-plate type waveguide.

By the above microwave energy radiating arrangement, microwave energy fed from a microwave generating source, is radiated into the oven chamber through the microwave radiating arrangement effectively, since the microwave energy fed through the central rod, is guided to the opening at periphery of the conductive plate or terminal of the arm by the tri-plate rotating waveguide.

As the microwave energy is radiated into the oven chamber from the openings of the radiating mean as vertical and horizontal polarized beam cyclically and the rotating arm is extending in one direction, the standing wave component in the oven chamber are very small. Therefore, it is easy to heat the material to be cooked uniformly and effectively.

These and other objects and features of this invention will become more appearant by the description in conjunction with following drawings.

BRIEF DESCRIPTION OF THE PRIOR ART

DESCRIPTION OF THE PREFERRED EMBODIMENTS

Figure 1:
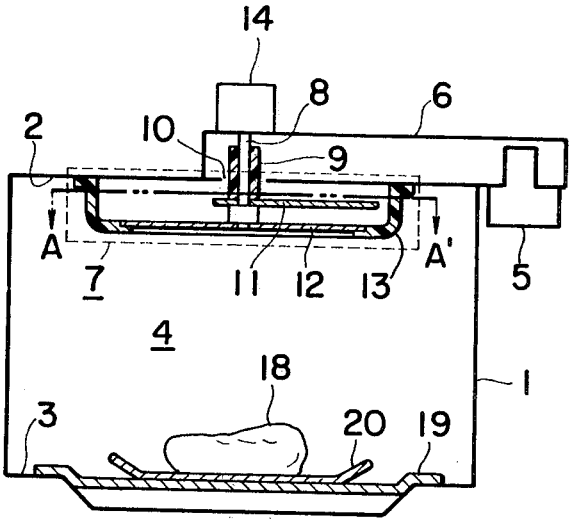
FIG. 1 shows a diagrammatic front view showing a microwave oven embodying one form of this invention.

Referring now to the drawing there is shown in FIG. 1 a microwave oven provided with metal walls 1, 2 and 3 enclosing the oven chamber 4. Microwave energy or electric power generated by a magnetron 5 is transfered into a microwave energy radiating arrangement 7 through a rectangular waveguide 6 mounted on an upper wall 2, and is radiated into an oven chamber 4.

The microwave radiating arrangement 7 is constructed by a coaxial rod having a conductive core rod 8 surrounded with a dielectric tube 9, a central portion of upper wall 2 having a hole at center thereof, a circular conductive plate 12, a rotatable conductive arm 11 and supporting member made with dielectric material 13 supporting the circular plate 12 to the wall 2 cylindlically.

One end of the rod 8 is rotatably at the center of the plate 12 and, another end is fixed to a shaft of a driving motor 14 through the waveguide 6. One end of the arm 11 is fixed to the central rod to be rotated.

Figure 2:
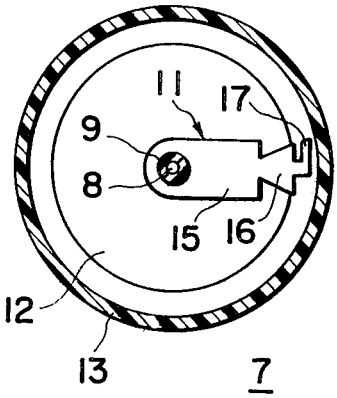
FIG. 2 shows a partial plan view seen from line A—A' in FIG. 1.

In FIG. 2, there is shown a plan view taken along the line A—A' of FIG. 1, the conductive arm 11 is constructed by a strip line 15 having characteristic impedance 50 ohm and a half wave length, a taper line portion 16 and a quarter wave length antenna 17 with a line folded in a circular direction. The taper line portion 16 converts the impedance no more than tens o. .ns at operation time into a waveguide impedance of about two hundreds ohms.

The circular plate 12 forms a shielding preventing the microwave energy from radiating downwards and forms a rotating tri-plate waveguide in connection with the upper walls 2 and the arm 11.

In the microwave radiating arrangement 7 described above, the microwave energy in the waveguide is fed into the microwave radiating arrangement 7 through the hole 10, is guided by the coaxial rod 8 and the rotating triplate waveguide, and is cyclically radiated into the oven chamber from the opening, that is, dielectric supporting material 13.

The antenna 17 produces a horizontal polarized radiation beam and radiates the beam in under or oblique directions due to the arrangement of the radial direction corresponding to the pheriphery of the circular plate 12.

A part of the microwave energy generated in the microwave radiating arrangement 7 is generated as a vertical polarized beam between the wall 2 and shielding plate 12 by virture of the central rod 8 and the arm 11, and is radiated from the supporting part at pheriphery of the shielding plate 12.

The vertical polarized beam is useful for improving the uniformity of heating in the vertical direction.

The ratio between the horizontal and vertical polarized beam energy is controlable by change of the radious of the shielding plate and the relative position between the shielding plate 12 and the upper wall 2.

In this manner, the radiation microwave beam is radiated into the oven chamber rotatably and cyclically from the pheriphery of the circular plate 12, and one part of the beam is impinged on the material 18 to be cooked directly, and the other is impinged on the material 18 after reflection by the walls 1, 2, 3 and the shielding plate 12, or through a plate 19 and a disk 20 made with a dielectric material so as to heat the material uniformly.

By our embodiment of a microwave oven in accordance with this invention, in which the frequency of the microwave is 2450 $MH_Z$, the diameter of the circular plate 12 is 215 mm, the space between the plate 12 and the upper wall 2 is 25 mm apart and the arm 11 are positioned in the center of the space, a desirable uniform heating characteristic has been obtained.

Figure 3:
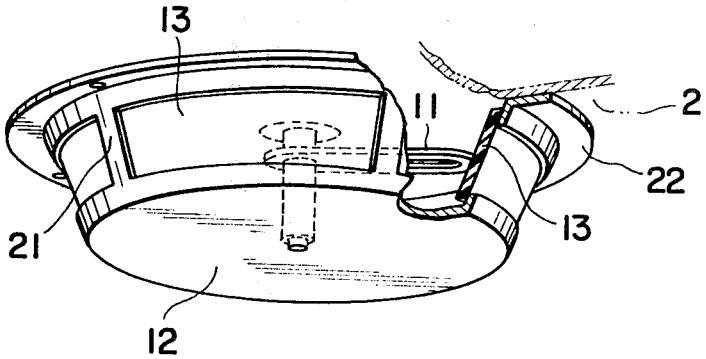
FIG. 3 shows a perspective view of one embodiment of a radiating means in accordance with this invention.

FIG. 3 shows a perspective view including a partial cross section of another embodiment of a microwave radiating arrangement according to this invention.

In this embodiment, in order to form the supporting parts and dielectric openings, the circular shielding plate 12 is unified with four metal supporting members 21 and frame 22. The openings are covered with conical dielectric material 13 from inside and form microwave radiating windows. In this case, the unified frame 22 is fixed on upper wall 2 directly or by sandwiching an insulating plate there between.

The radiation arrangement shown in FIG. 3 has the same effects as one shown in FIG. 1, and is mechanically strong. Further, as another merit of this embodiment, it is possible to use the reactance of the four supporting members as output matching elements and uniform heating elements by arranging the four supporting members in the diagonal positions of the wall 2 or in the position apart 45° therefrom in order to minimize the dependency that the impedance of the oven chamber seen from the microwave source 5 depends on the rotation angle of the rotation arm 11.

Figure 4:
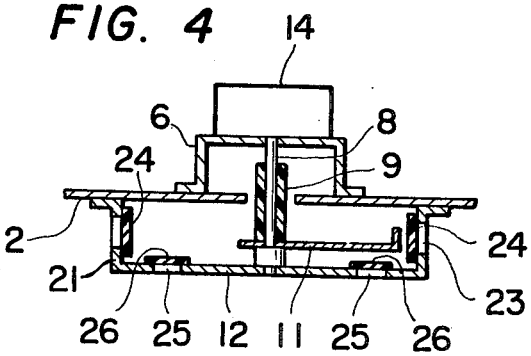
FIG. 4 shows a side cross sectional view of one embodiment of a radiating means in accordance with this invention.

FIG. 4 shows a cross sectional side view of another embodiment of a radiating arrangement in accordance with this invention.

The construction and operation of this embodiments are substantially same as one shown in FIG. 1 except an end portion of a rotating arm, a supporting part 21 and apertures 25 in a plate 12. The supporting part is made with the same material as the plate 12 is unified with the plate 12 and is arranged vertical to the plate 12. The supporting part or side wall has a plurality of windows or opening 23 through which microwave energy is radiated as a vertical polarized beam. Further, the circular plate 12 has windows at a periphery portion through which microwave energy is radiated as a horizontal polarized beam. These windows or openings are covered with dielectric material members 24 and 26.

One end of the arm 11 near the windows is folded upwards.

This invention is not limited to the embodiments described above. The rotating arm is in many other shapes. For example, the taper line 16 shown in FIG. 2 as an impedance matching means is replaceable by a quarter wave line having a suitable characteristic impedance. It is, also, possible to determine the length of the rod 9 in order to match the output of the radiating arrangement 7.

The circular plate 12 is changeable to a regular polygon shape plate to improve the uniformity of heating further and the matching of the output in correspondence to the shape of the oven chamber 4.

When the arm 11 is located about one-16th wave length to the upper wall 2, it is possible to eliminate the central portion of the plate 12 since the center portion near the hole 10 operates equivalently as a shielding plate and acts as a short circuit for the horizontal electric field near the center portion of the radiating means. If necessary, the dielectric material covering the windows may be omitted.

As described above, one feature of the radiating arrangement used in a microwave oven in accordance with this invention, is that the material to be cooked is heated uniformly since microwave energy is radiated symmetrically as vertical and horizontal polarized beams from the periphery of the radiating arrangement with simple structure. Over heating directly under the central of upper wall is protected.

Other feature of this invention includes the fact that the space of the oven chamber is used effectively since the radiating arrangement is formed flat. Additionally, it is possible to manufacture a microwave oven economically since the radiating means has simple structure and it is easy to regulate the microwave radiation.

We claim:

1. A microwave oven including an oven chamber having walls and a microwave energy radiating means disposed in the oven chamber for radiating microwave energy fed from a microwave source into the interior of the oven chamber, characterized in that the microwave energy radiating means comprises a rotatable rod extending into the oven chamber through a hole located substantially in the center of one wall of the oven chamber, a rotating conductive arm having one end secured to the central rod and extending transversely thereto, a conductive plate having the center thereof coincident with the axis of the central rod, and supporting means supporting the conductive plate in the vicinity of the one wall and substantially parallel thereto so that the rotating arm is interposed between the one wall and the conductive plate, and openings for radiating microwave energy into the oven chamber being provided at least at the periphery of the conductive plate.

2. A microwave oven according to claim 1, wherein said supporting means is formed of dielectric material.

3. A microwave oven according to claim 1, wherein said supporting means is formed of the same material as the conductive plate and is unified therewith, said supporting means having a plurality of openings therein.

4. A microwave oven according to claim 3, wherein said openings are covered with dielectric material.

5. A microwave oven according to claim 1, wherein said rotating arm is formed with a half wave length strip line, a taper line for converting the characteristic impedance and a quarter wavelength line folded in a direction transverse to the extending direction of the arm.

6. A microwave oven according to claim 1, wherein said conductive plate is a circular conductive plate.

7. A microwave oven according to claim 1, wherein said conductive plate is in the shape of a regular polygon.

8. A microwave oven according to claim 1, wherein the walls of the oven chamber are metal walls.

9. A microwave oven according to claim 1, wherein the microwave energy radiating mean radiates vertical and horizontal polarized beams of microwave energy into the microwave oven.

* * * * *